US009638500B1

(12) United States Patent
Blyskal et al.

(10) Patent No.: US 9,638,500 B1
(45) Date of Patent: May 2, 2017

(54) FRAGMENTATION WARHEAD WITH FLEXIBLE LINER

(71) Applicants: Tomasz Blyskal, Flemington, NJ (US); Peter Rottinger, Sussex, NJ (US)

(72) Inventors: Tomasz Blyskal, Flemington, NJ (US); Peter Rottinger, Sussex, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 429 days.

(21) Appl. No.: 14/267,067

(22) Filed: May 1, 2014

Related U.S. Application Data

(60) Provisional application No. 61/824,554, filed on May 17, 2013.

(51) Int. Cl.

| | |
|---|---|
| ***F42B 10/00*** | (2006.01) |
| ***F42B 12/00*** | (2006.01) |
| ***F42B 30/00*** | (2006.01) |
| ***F42B 12/22*** | (2006.01) |
| ***F42B 12/72*** | (2006.01) |

(52) U.S. Cl.
CPC ..... *F42B 12/22* (2013.01); *F42B 12/72* (2013.01)

(58) Field of Classification Search
CPC ..... F42B 12/22; F42B 12/72
USPC ..... 102/306–310, 475, 476, 506, 389
See application file for complete search history.

(56) References Cited

U.S. PATENT DOCUMENTS

| | | | | |
|---|---|---|---|---|
| 2,682,834 A * | 7/1954 | Church | F42B 3/08 | 102/307 |
| 2,797,892 A * | 7/1957 | Ryan | E21B 7/007 | 102/307 |
| 2,831,429 A * | 4/1958 | Moore | F42B 3/08 | 102/307 |
| 3,136,249 A * | 6/1964 | Poulter | F42B 1/032 | 102/309 |
| 4,312,274 A * | 1/1982 | Zernow | F42B 12/22 | 102/493 |

* cited by examiner

*Primary Examiner* — Samir Abdosh
(74) *Attorney, Agent, or Firm* — Michael C. Sachs

(57) ABSTRACT

A fragmentation warhead with a flexible liner enables increased control of the warhead's fragmentation pattern. The flexible liner is fixed to a rigid portion of the warhead housing. Explosive material is contained in the housing. A fluid is disposed between the explosive material and the flexible liner to function as a shock transition material. The fluid is contiguous with and bears on an inner surface of the flexible liner. A plurality of rigid fragments or a plurality of explosively formed projectile (EFP) liners are fixed to an outer surface of the flexible liner opposite the fluid. Initiation of the explosive material propels the fragments or EFP liners in directions that may be varied by varying the shape of the flexible liner.

23 Claims, 10 Drawing Sheets

FRAGMENTATION WARHEAD WITH FLEXIBLE LINER

CROSS-REFERENCE TO RELATED APPLICATIONS

The present application claims the benefit of priority of U.S. provisional patent application Ser. No. 61/824,554 filed on May 17, 2013, which is incorporated by reference herein.

STATEMENT OF GOVERNMENT INTEREST

The inventions described herein may be manufactured, used and licensed by or for the United States Government.

BACKGROUND OF THE INVENTION

The invention relates in general to munitions and in particular to fragmentation warheads.

The fragmentation effects of a warhead can be delivered by a variety of known techniques. In some cases, unintended collateral damage may be caused by warhead fragments. A need exists for an apparatus and method to direct or channel the fragmentation effects of a warhead to a targeted area, while simultaneously eliminating excess fragmentation and collateral damage.

SUMMARY OF INVENTION

One aspect of the invention is a fragmentation warhead with a central longitudinal axis and a housing. The housing includes a portion formed of a flexible liner and a portion formed of a rigid material. A high explosive material is disposed in the housing. A fluid is disposed between the high explosive material and the flexible liner. The fluid is contiguous with and bears on an inner surface of the flexible liner. A plurality of rigid fragments or a plurality of explosively formed projectile liners are fixed to an outer surface of the flexible liner opposite the fluid.

The fluid may be an energetic material. The fluid and the high explosive material may be the same viscous material.

In one embodiment, the rigid material portion of the housing may be generally in the shape of a hollow right circular cylinder having one open end and a central longitudinal axis. The flexible liner may be fixed to the perimeter of the one open end. The rigid material portion may include a telescoping portion that moves the flexible liner between concave, neutral, and convex positions. The flexible liner may be symmetric about the central longitudinal axis of the warhead.

In another embodiment, the rigid material portion of the housing may include a pair of opposed end plates and the flexible liner may be fixed to and extend between the pair of opposed end plates to form a side wall of the housing. The side wall of the housing may be movable between concave, neutral, and convex positions by altering a volume of the fluid in the housing.

A framework in the form of a grid may be disposed between the side wall and the high explosive material. The grid may include a plurality of longitudinal members extending between the pair of opposed end plates and a plurality of circumferential members extending around the side wall. The side wall may be fixed to the plurality of longitudinal members and the plurality of circumferential members to form an individually movable sub-curvature for each opening in the grid. The sub-curvatures may be movable between concave, neutral, and convex positions by altering the volume of the fluid in the housing.

Another aspect of the invention is a method that includes providing a warhead having a flexible liner and adjusting a shape of the flexible liner to thereby alter a fragmentation pattern of the warhead.

The step of adjusting may include adjusting the shape of the flexible liner between concave, neutral, and convex positions.

In one embodiment, the step of adjusting includes adjusting the shape of the flexible liner by altering a volume fluid in the warhead.

In another embodiment, the step of adjusting includes translating a telescoping portion of the housing of the warhead.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel fragmentation warhead has a housing formed in part by a rigid material and in part by a flexible liner. The warhead has a central longitudinal axis. An explosive composition, such as a high explosive material, is disposed in the housing. A fluid is disposed in the housing between the explosive material and the flexible liner. The fluid is contiguous with and bears on an inner surface of the flexible liner. A plurality of rigid fragments are fixed to an outer surface of the flexible liner opposite the fluid. The rigid fragments are propelled at a high velocity by energy produced when the explosive material is initiated.

In some embodiments, a plurality of explosively formed projectile (EFP) liners may be used in lieu of the plurality of rigid fragments. That is, a plurality of EFP liners may be fixed to the outer surface of the flexible liner, rather than a plurality of rigid fragments.

In some embodiments, the fluid and the explosive material may be the same viscous material.

In some other embodiments, the fluid and the high explosive material may be different materials. By way of example only, the fluid may be oil and the explosive material may be a solid material.

The configuration or shape of the flexible liner with the fragments (or EFP liners) fixed thereto may be adjusted or changed prior to reaction of the explosive material. Adjustment of the flexible liner changes the cone angle of the fragment pattern. The fragment pattern may be adjusted in a continuous manner from a diverging pattern to a linear or neutral pattern to a converging pattern.

In some embodiments, the fragments may be propelled in directions that are parallel or acutely angled with respect to the central longitudinal axis of the warhead. These embodiments are "end-fired" warheads. In the end-fired warheads, adjustment of the shape of the flexible liner may be enabled by altering the volume of fluid in the warhead or by translating a telescoping portion of the rigid part of the housing.

In some other embodiments, the fragments may be propelled in directions that are generally radial with respect to the central longitudinal axis of the warhead. These embodiments are "side-fired" warheads. In the side-fired warheads, adjustment of the shape of the flexible liner may be enabled by altering the volume of fluid in the warhead.

The novel warhead may be used in a variety of ways. By way of example only, the warhead may be placed by hand and remotely detonated, or the warhead may be launched from a gun tube. In some embodiments, the flexible liner may be adjusted manually. In other embodiments, the flexible liner may be adjusted by a remotely-operated mechanism.

FIGS. 1-4 are views of an embodiment of an end-fired fragmentation warhead. FIGS. 5-10 are views of embodiments of side-fired fragmentation warheads.

Figure 1B:
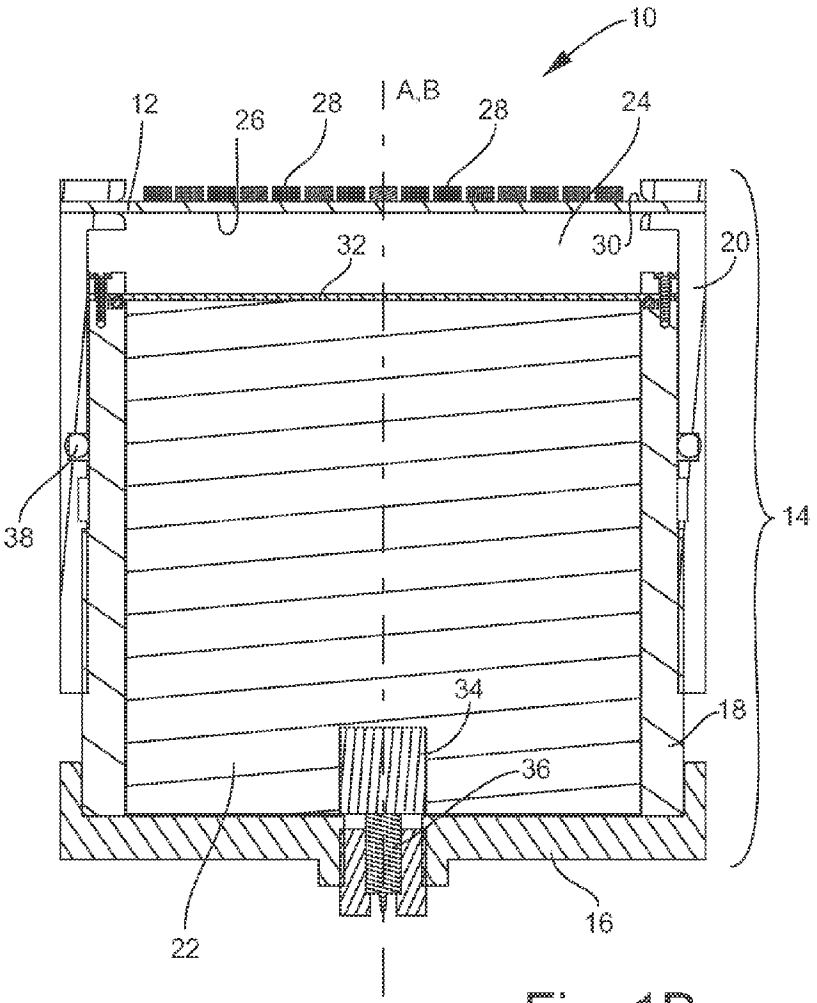
FIG. 1B is a sectional elevation view along the line 1B-1B of the warhead of FIG. 1A, with the flexible liner in a neutral position.
Figure 1A:
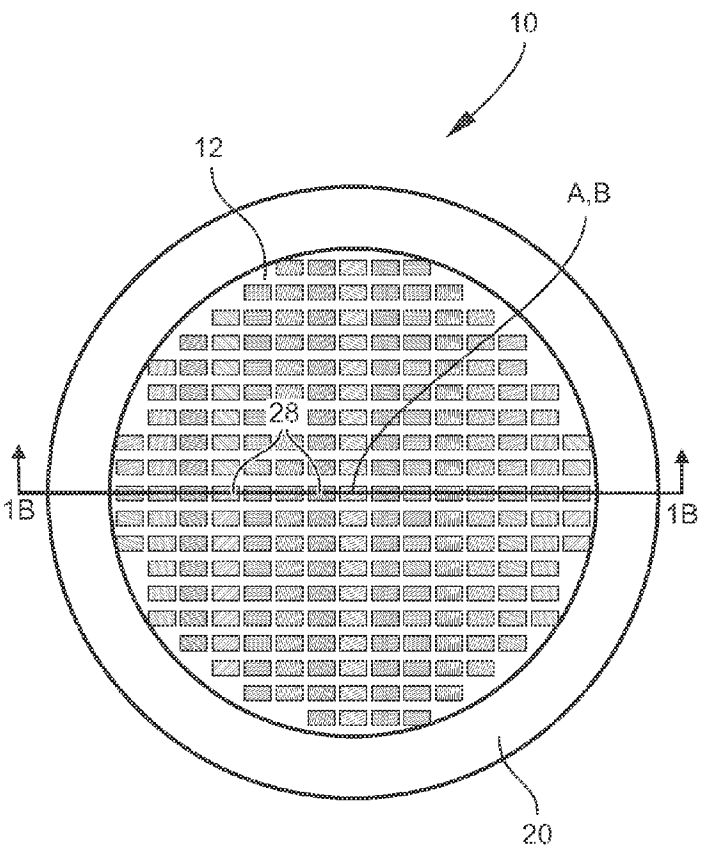
FIG. 1A is a top view of an embodiment of an end-fired warhead with a flexible liner.

FIG. 1A is a top view of an embodiment of an end-fired warhead 10 with a flexible liner 12 in a neutral position. FIG. 1B is a sectional elevation view of the end-fired warhead 10 of FIG. 1A. Warhead 10 has a central longitudinal axis A. The housing 14 of warhead 10 includes flexible liner 12 and a rigid portion. The flexible liner 12 may be made of, for example, neoprene. The rigid portion includes an end cap 16, a cylinder 18 fixed to end cap 16, and a telescoping portion 20. The rigid portion may be made of, for example, steel.

Telescoping portion 20 is translatable with respect to cylinder 18 in the direction of axis A. A sealing ring 38 for sealing fluid may be disposed between telescoping portion 20 and cylinder 18. The rigid portion of housing 14 is generally in the shape of a hollow right circular cylinder having a central longitudinal axis B and an open end which is closed by flexible liner 12. The flexible liner 12 is fixed to the perimeter of the telescoping portion 20 and may be symmetric about axes A and B. Axes A and B are coincident.

An explosive material, such as a high explosive material 22, is disposed in housing 14. A fluid 24 is disposed between high explosive material 22 and flexible liner 12. Fluid 24 is contiguous with and bears on an inner surface 26 of the flexible liner 12. Fluid 24 functions as a shock transition material. Fluid 24 may be, for example, oil, such as hydraulic oil. A plurality of rigid fragments 28 are fixed to an outer surface 30 of the flexible liner 12 opposite the fluid 24. Fragments 28 may be made of, for example, steel or other materials. Fragments 28 may be fixed to liner 12 by, for example, gluing. As mentioned previously, a plurality of mini-EFP liners (not shown) may be used in lieu of fragments 28.

In the embodiment shown, the fluid 24 is separated from explosive 22 by a membrane or plate 32. However, fluid 24 and explosive 22 may be the same material, for example, a viscous explosive material, in which case membrane 32 is not needed.

An explosive booster 34 may be disposed in explosive 22 and a detonator 36 disposed adjacent booster 34. By way of example only, detonator 36 may be activated by a wireless electromagnetic signal or a known warhead fuze.

Telescoping portion 20 may be translated with respect to cylinder 18 in the direction of axis A to thereby alter the shape or position of flexible liner 12 between concave, neutral, and convex positions. In FIG. 1B, flexible liner 12 is in a neutral position, that is, liner 12 is planar and horizontal. When explosive 22 initiates, fragments 28 will generally be propelled in directions parallel to axis A.

Figure 2:
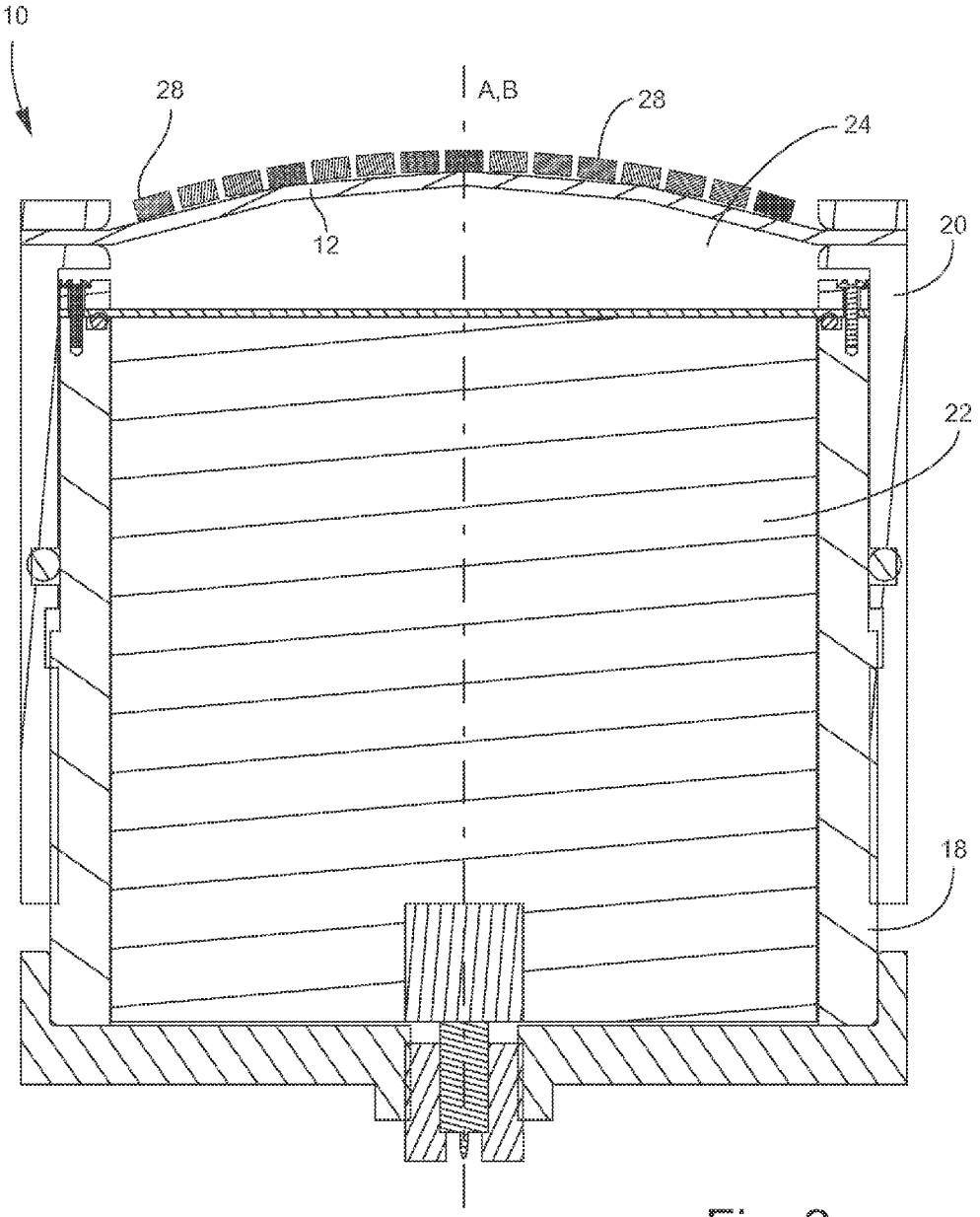
FIG. 2 is a sectional elevation view of the warhead of FIG. 1A with the flexible liner in a convex or divergent position.

In FIG. 2 and as compared to FIG. 1B, telescoping portion 20 has been translated downward with respect to cylinder 18 thereby causing fluid 24 to move liner 12 into a convex or divergent position. When explosive 22 initiates, fragments 28 will generally be propelled in directions that diverge from axis A.

Figure 3:
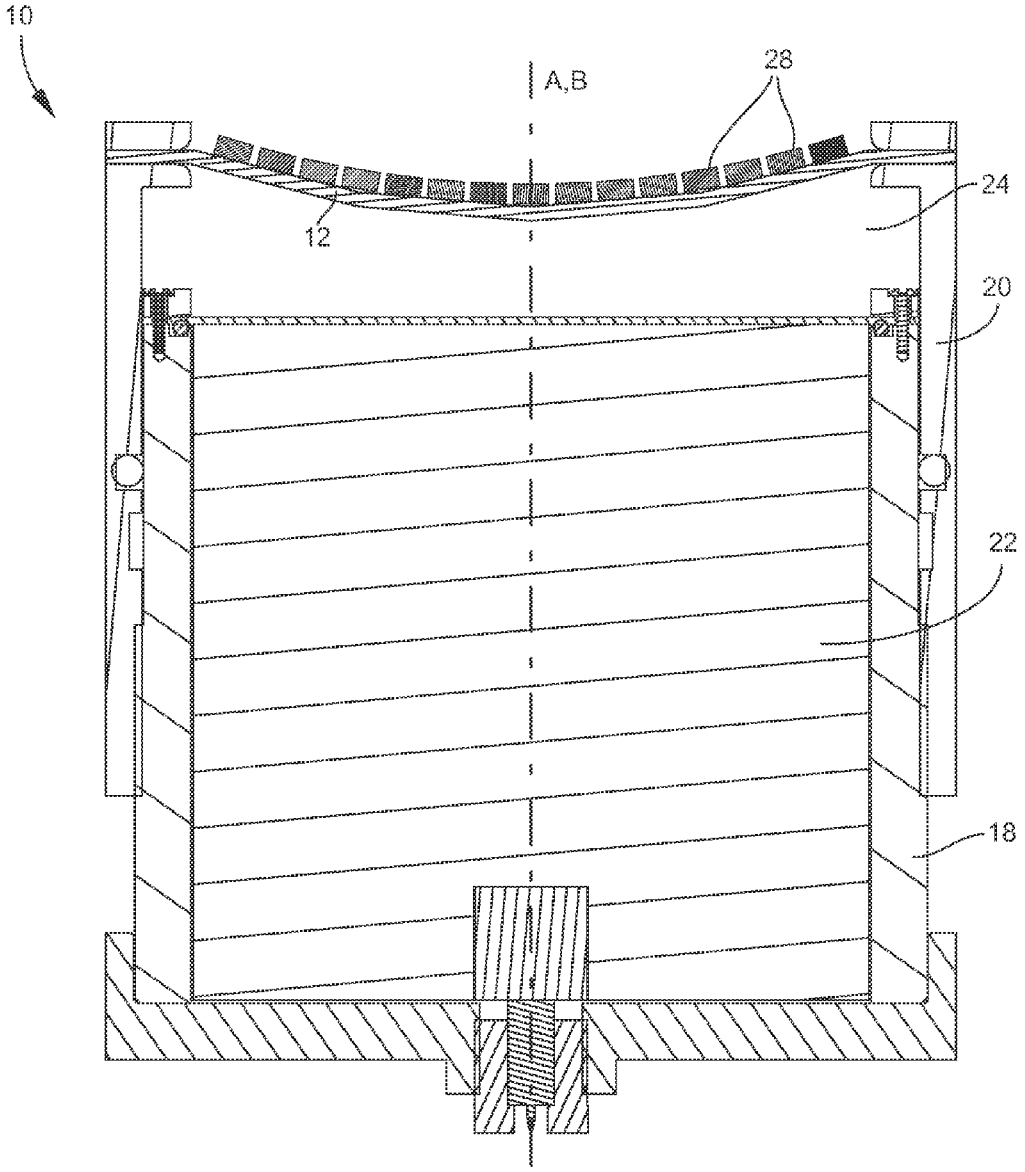
FIG. 3 is a sectional elevation view of the warhead of FIG. 1A with the flexible liner in a concave or convergent position.

In FIG. 3 and as compared to FIG. 1B, telescoping portion 20 has been translated upward with respect to cylinder 18 thereby causing liner 12 to assume a concave or convergent shape. When explosive 22 initiates, fragments 28 will generally be propelled in directions that converge toward axis A.

Figure 4:
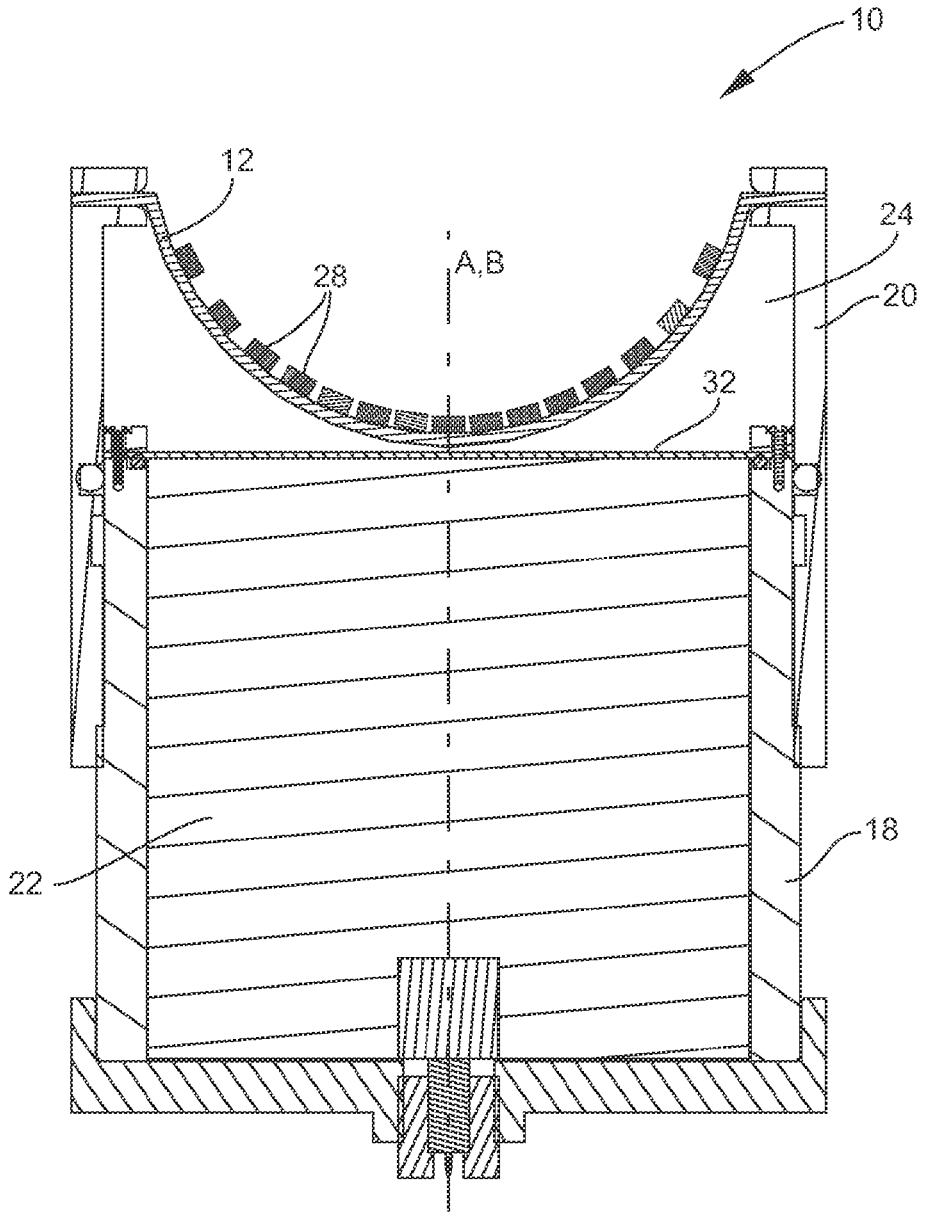
FIG. 4 is a sectional elevation view of the warhead of FIG. 1A with the flexible liner in a more concave position than in FIG. 3.

In FIG. 4 and as compared to FIG. 3, telescoping portion 20 has been translated further upward with respect to cylinder 18 thereby causing liner 12 to assume a more concave or convergent shape than in FIG. 3. When explosive 22 initiates, fragments 28 will generally be propelled in directions that sharply converge toward axis A and may form a focused fragment array (FFA).

Telescoping portion 20 may be translated with respect to cylinder 18 by hand or by a machine, using a variety of known techniques and mechanisms. For example, telescoping portion 20 and cylinder 18 may be threadingly engaged and rotated with respect to each other by hand or by well-known mechanisms, such as an electric motor drive. The translating mechanism may be placed in a gun-launched projectile with warhead 10 so that translation of portion 20 may occur after the projectile is loaded in a launching tube or during the flight of the projectile.

In the embodiment of warhead 10 shown in FIGS. 1-4, the shape of liner 12 is varied by translating telescoping portion 20 with respect to cylinder 18. In a variation of warhead 10, telescoping portion 20 and cylinder 18 may form a single unitary side wall without a translating portion. In this variation, the volume of fluid 24 in warhead 10 may be increased or decreased to thereby create the variations in the shape of liner 12 shown in FIGS. 1B and 2-4. Fluid 24 may be added by through a fluid fitting (not shown) in the unitary side wall. A pump connected to a reservoir may be used to add or remove fluid 24 from the warhead 10, depending on the desired configuration of liner 12 (i.e., neutral, convex, concave). The pump may be manually operated, or a pump/motor combination and reservoir may be disposed in a projectile with warhead 10 to enable changes in the shape of liner 12 after the projectile is loaded in a launch tube or while the projectile is in flight.

Figure 5B:
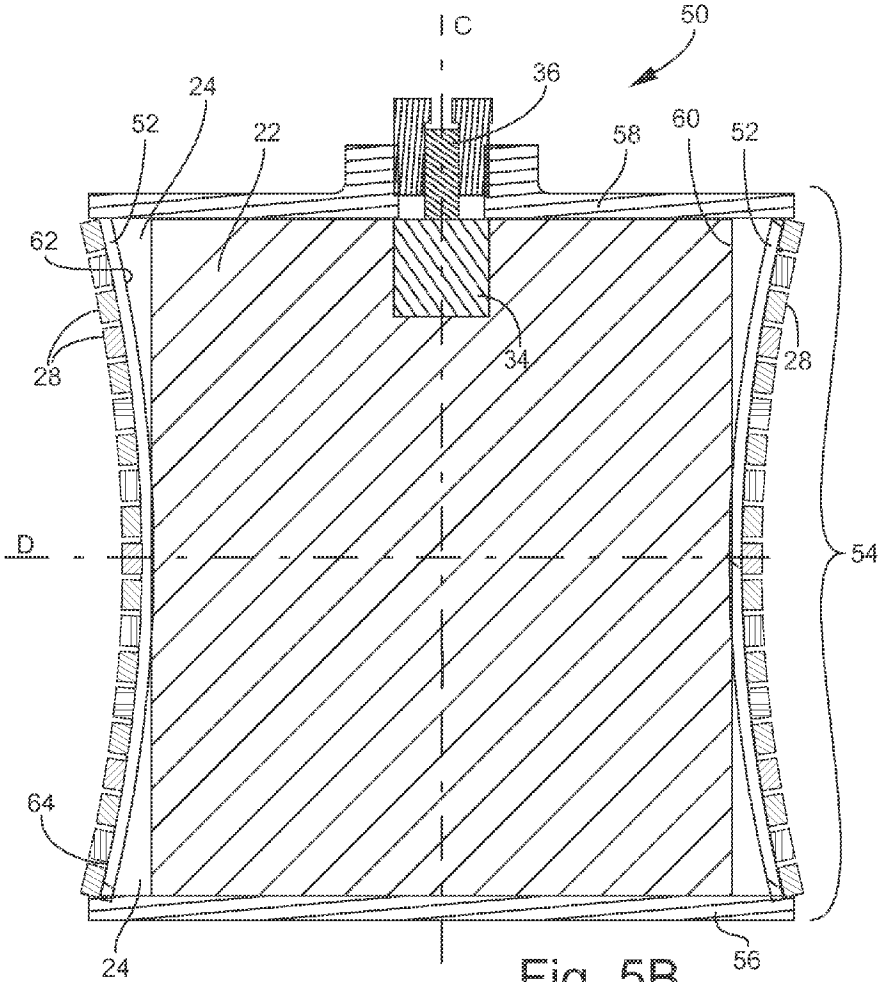
FIG. 5B is a sectional view along the line 5B-5B of the warhead of FIG. 5A with the flexible liner in a concave or convergent position.
Figure 5A:
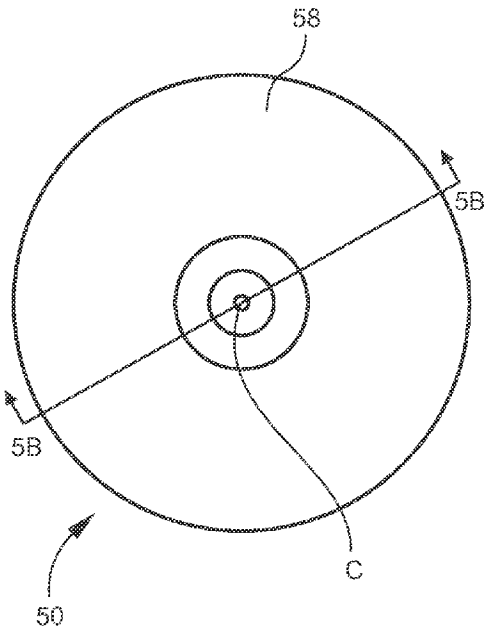
FIG. 5A is a top view of an embodiment of a side-fired warhead with a flexible liner.

FIG. 5A is a top view of an embodiment of a side-fired warhead 50 having a central longitudinal axis C. FIG. 5B is a sectional view taken along the line 5B-5B of FIG. 5A showing the flexible liner 52 in a concave or convergent position. The housing 54 of warhead 50 includes flexible liner 52 and a rigid portion. The rigid portion includes a pair of opposed end plates 56, 58. Flexible liner 52 is fixed to and extends between the opposed end plates 56, 58. Liner 52 forms a side wall of the housing 54. Preferably, liner 52 extends circumferentially 360 degrees to form the complete side wall of the housing. The flexible liner 52 may be symmetric about axis C.

Explosive material 22 is disposed in housing 54. A fluid 24 is disposed between explosive material 22 and flexible liner 52. Fluid 24 is contiguous with and bears on an inner surface 62 of the flexible liner 52. Fluid 24 functions as a shock transition material. Fluid 24 may be, for example, oil, such as hydraulic oil. A plurality of rigid fragments 28 (or mini-REP liners) are fixed to an outer surface 64 of the flexible liner 52 opposite the fluid 24. Fragments 28 may be made of, for example, steel or other materials In the embodiment of warhead 50 shown, the fluid 24 is separated from explosive 22 by a cylindrical membrane or plate 60. However, fluid 24 and explosive 22 may be the same material, for example, a viscous explosive material, in which case membrane 60 is not needed. If fluid 24 and explosive 22 are both a viscous energetic material, then an internal supporting structure (not shown) would be needed.

An explosive booster 34 may be disposed in explosive 22 and a detonator 36 disposed adjacent booster 34. By way of example only, detonator 36 may be activated by a wireless electromagnetic signal or a known warhead fuze.

The volume of fluid 24 in warhead 50 may be increased or decreased to thereby create variations in the shape of liner 52. Liner 52 is in a concave or convergent configuration in FIG. 5B. When explosive 22 is initiated, fragments 28 will be propelled generally in directions that converge toward axis D, which is normal to axis C.

Adding additional fluid 24 to warhead 50 causes liner 52 to assume a neutral configuration (not shown) wherein liner 52 has a shape of a right circular cylinder centered on axis C. In the neutral configuration of liner 52, fragments 28 will be propelled in directions parallel to axis D.

Figure 6:
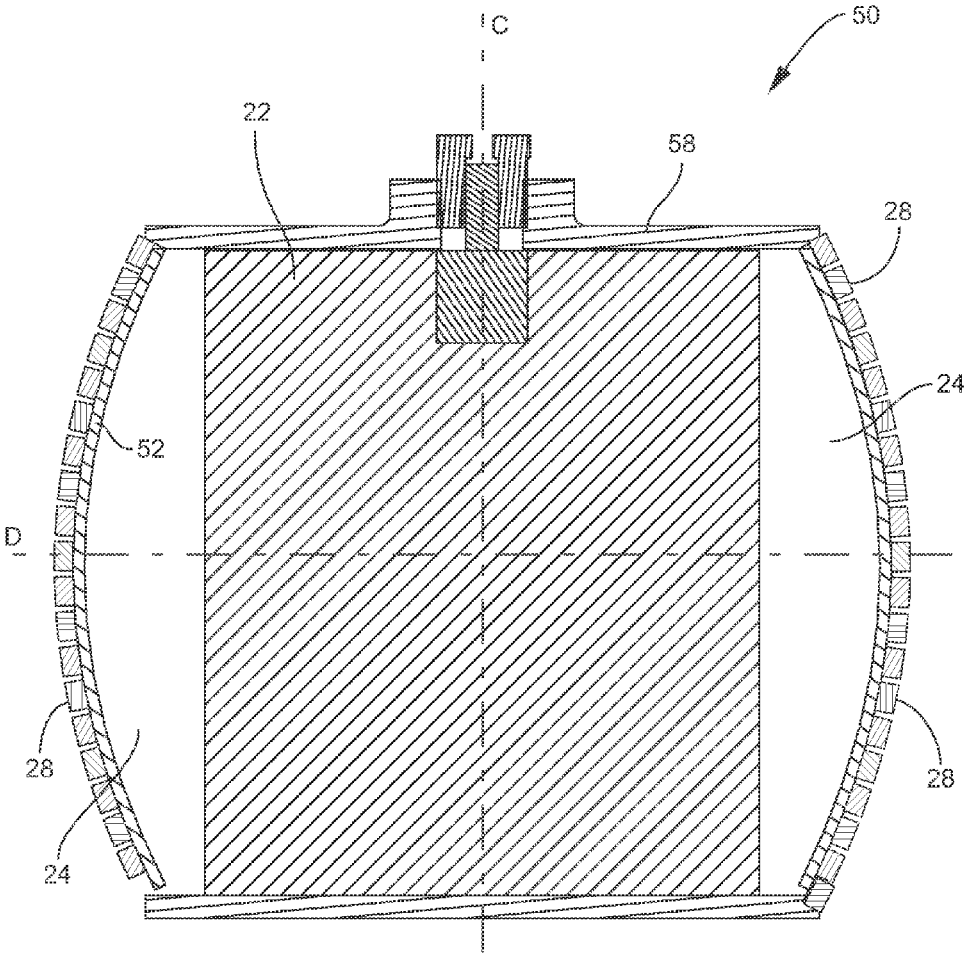
FIG. 6 is a sectional view of the warhead of FIG. 5A with the flexible liner in a convex or divergent position.

From the neutral configuration of liner 52, the addition of more fluid 24 causes liner 52 to assume a convex or divergent configuration shown in FIG. 6. When explosive 22 is initiated, fragments 28 will be propelled generally in directions that diverge away from axis D.

Fluid 24 may be added through a fluid fitting (not shown) in one of the end plates 56, 58. A pump connected to a reservoir may be used to add or remove fluid 24 from warhead 50, depending on the desired configuration of liner 52 (i.e., neutral, convex, concave). The pump may be manually operated, or a pump/motor combination and reservoir may be disposed in a projectile with warhead 50 to enable changes in the shape of liner 52 after the projectile is loaded in a launch tube or while the projectile is in flight.

Figure 7B:
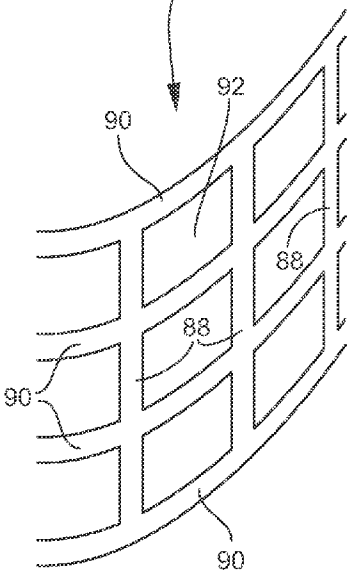
FIG. 7B is a perspective view of a portion of an internal grid.
Figure 7A:
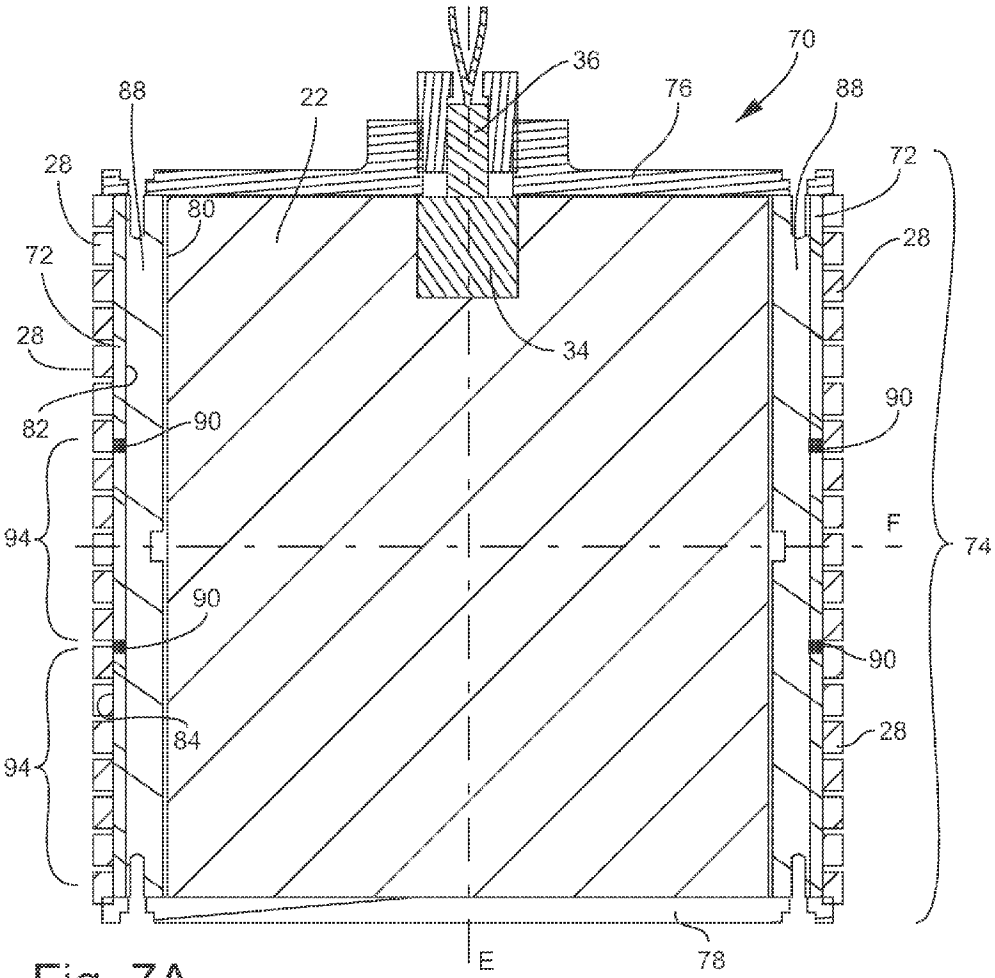
FIG. 7A is a sectional view of an embodiment of a side-fired warhead having a flexible liner and an internal grid.

Other embodiments of novel side-fired warheads are similar to warhead 50, but include an internal rigid grid. The flexible liner is fixed to the internal grid to form a plurality of individually deformable "sub-curvatures." FIG. 7A is a sectional view of an embodiment of a side-fired fragmentation warhead 70 with an internal rigid grid. The internal grid 86 alone is shown in a partial perspective view in FIG. 7B. Warhead 70 includes a housing 74 formed by pair of rigid end plates 76, 78 and a flexible liner 72. Warhead 70 has a central longitudinal axis E.

Liner 72 forms the side wall of warhead 70. Fragments 28 are fixed to an outer surface 84 of liner 72. Explosive material 22 is disposed in the housing 74. An explosive booster 34 may be disposed in explosive 22 and a detonator 36 disposed adjacent booster 34. By way of example only, detonator 36 may be activated by a wireless electromagnetic signal or a known warhead fuze.

A framework in the form of an internal grid 86 is disposed between the liner 72 and the explosive material 22. The grid 86 includes a plurality of longitudinal members 88 that extend between the pair of opposed end plates 76, 78 and a plurality of circumferential members 90 that extend circumferentially around the warhead 70. The circumferential members 90 are fixed to the longitudinal members 88 at their points of intersection. The plurality of longitudinal members 88 may be circumferentially equally spaced. The plurality of circumferential members 90 may be longitudinally equally spaced. The members 88, 90 may be made of a metal, for example, steel.

Liner 72 is fixed to the plurality of longitudinal members 88 and the plurality of circumferential members 90 to form an individual, flexible sub-curvature 94 for each opening 92 (FIG. 7B) in the grid. Not seen in FIG. 7A is the fluid 24 (see FIGS. 8-10) disposed between liner 72 and explosive 22. In FIG. 7A, the liner 72 is in the neutral position wherein the fragments 28 will be propelled in directions generally parallel to radial axes which are normal to axis E, such as radial axis F.

Figure 8:
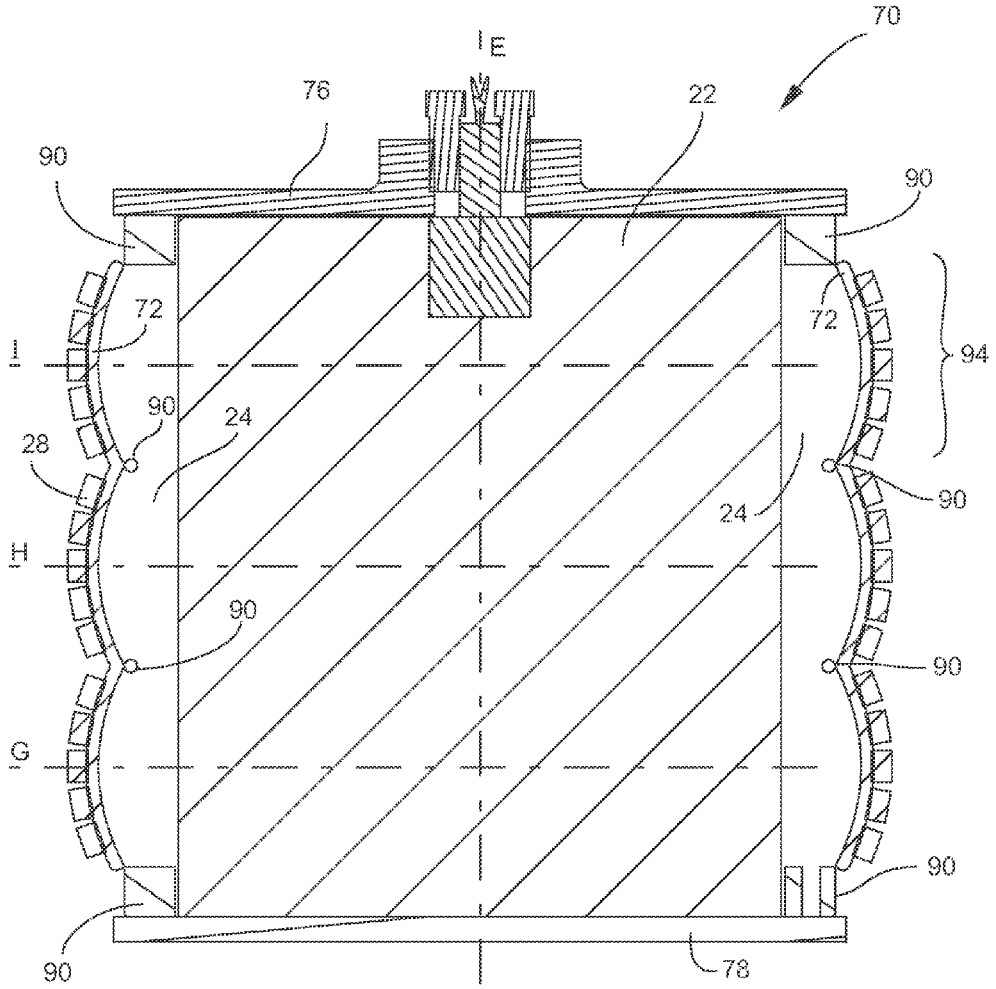
FIG. 8 is a sectional view of the warhead of FIG. 7A showing the sub-curvatures in convex or diverging positions.

FIG. 8 is a sectional view of the warhead 70 of FIG. 7A showing the sub-curvatures 94 in convex or diverging positions. An increase in the volume of fluid 24 in warhead 70 causes the sub-curvatures 94 to move from the neutral positions of FIG. 7A to the diverging positions of FIG. 8. When explosive 22 in warhead 70 of FIG. 8 initiates, fragments 28 will be propelled in directions that diverge from radial axes which are normal to axis E, such as radial axes G, H and I.

Figure 9:
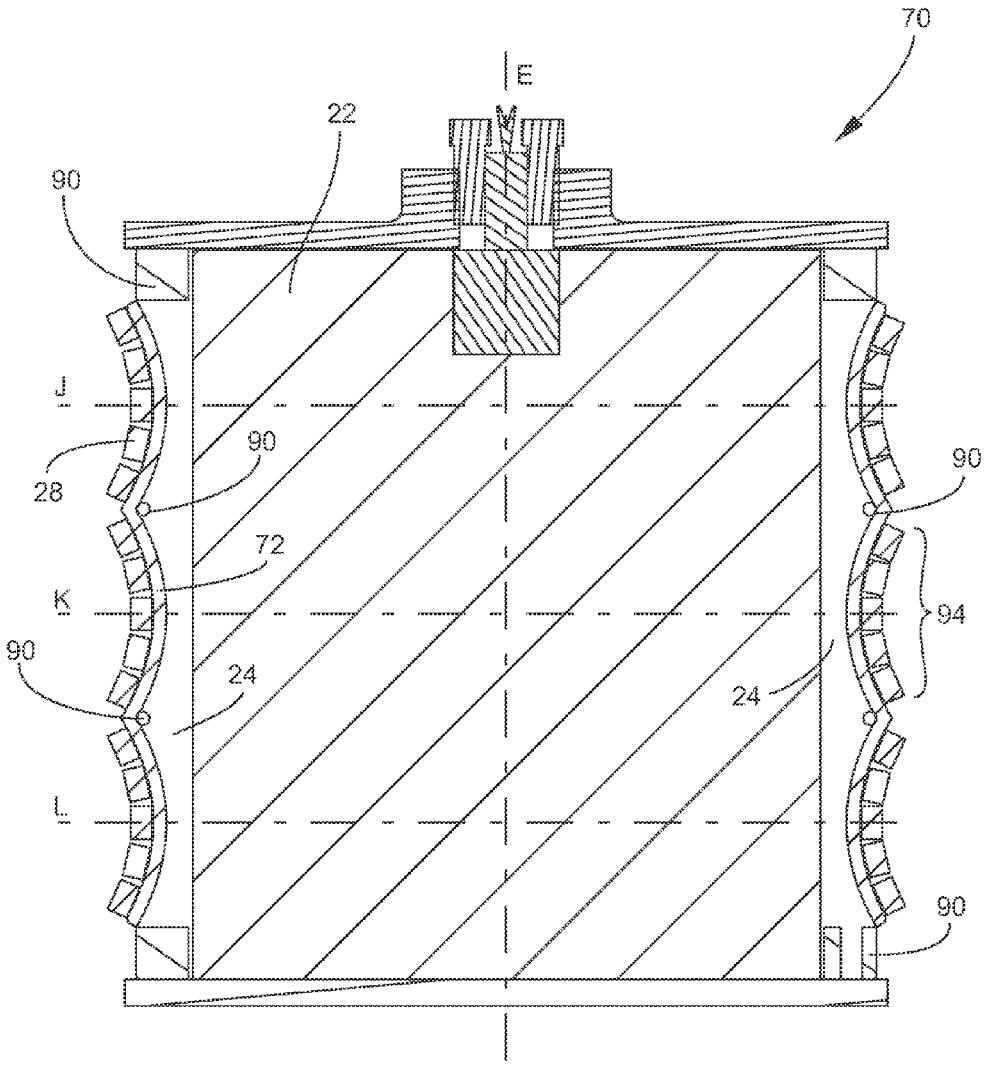
FIG. 9 is a sectional view of the warhead of FIG. 7A showing the sub-curvatures in concave or converging positions.

FIG. 9 is a sectional view of the warhead of FIG. 7A showing the sub-curvatures 94 in concave or converging positions. A decrease in the volume of fluid 24 in warhead 70 causes the sub-curvatures 94 to move from the neutral positions of FIG. 7A to the converging positions of FIG. 9. When explosive 22 in warhead 70 of FIG. 9 initiates, fragments 28 will be propelled in directions that converge toward radial axes which are normal to axis E, such as radial axes J, K and L.

Figure 10:
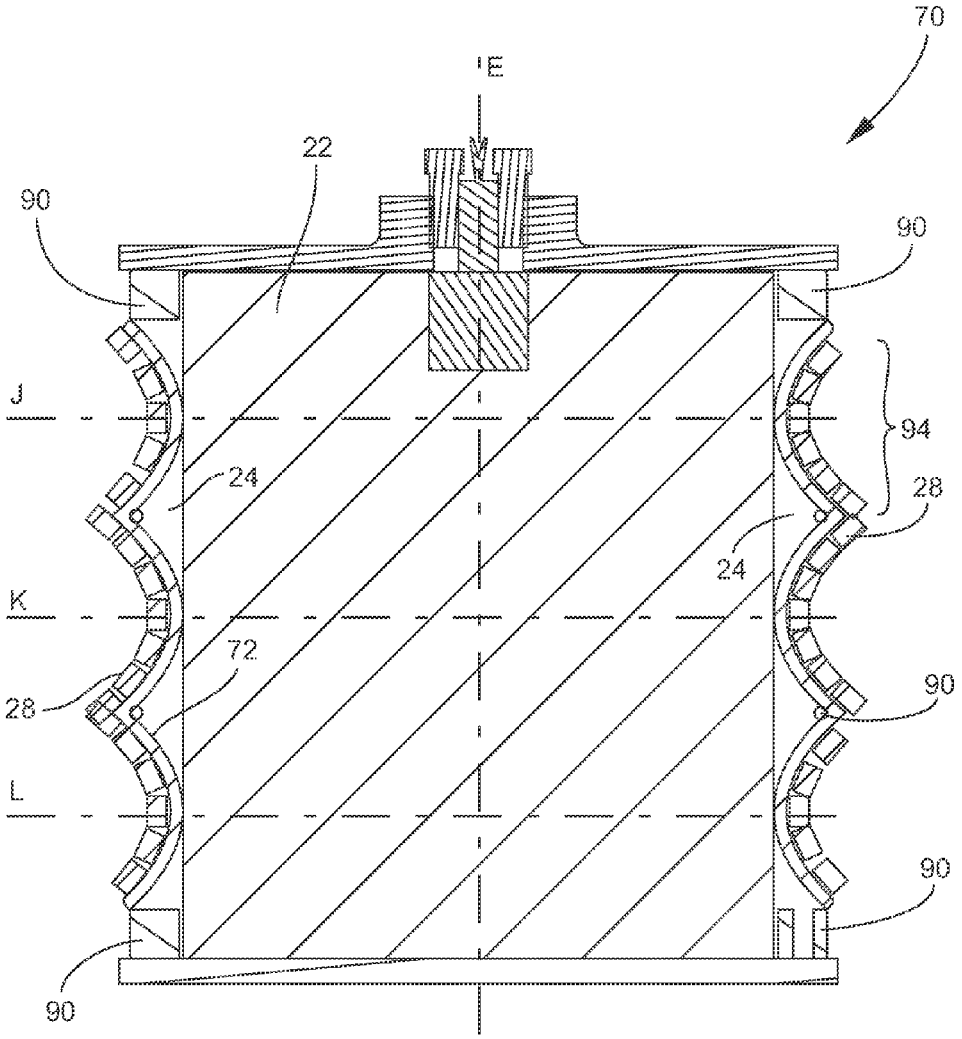
FIG. 10 is a sectional view of the warhead of FIG. 7A showing the sub-curvatures in more concave positions than in FIG. 9.

FIG. 10 is a sectional view of the warhead 70 of FIG. 7A showing the sub-curvatures in more concave positions than in FIG. 9. A decrease in the volume of fluid 24 in warhead 70 causes the sub-curvatures 94 to move from the concave positions of FIG. 9 to the more concave positions of FIG. 10. When explosive 22 in warhead 70 of FIG. 10 initiates, fragments 28 will be propelled in directions that diverge from radial axes which are normal to axis E, such as radial axes J, K and L.

While the invention has been described with reference to certain embodiments, numerous changes, alterations and modifications to the described embodiments are possible without departing from the spirit and scope of the invention as defined in the appended claims, and equivalents thereof.

What is claimed is:

1. A fragmentation warhead with a central longitudinal axis, comprising:

a housing having a portion formed of a flexible liner and a portion formed of a rigid material;

a high explosive material disposed in the housing;

a fluid disposed between the high explosive material and the flexible liner, the fluid being contiguous with and bearing on an inner surface of the flexible liner; and, where a wall of the housing is movable between concave, neutral, and convex positions by altering the volume of said fluid; and, one of a plurality of rigid fragments and a plurality of explosively formed projectile liners fixed to an outer surface of the flexible liner opposite the fluid.

2. The warhead of claim 1, wherein the fluid is a second high explosive material.

3. The warhead of claim 2, wherein the high explosive material and the second high explosive material are a same viscous material.

4. The warhead of claim 1, wherein the fluid is oil.

5. The warhead of claim 1, wherein the rigid material portion of the housing is generally in a shape of a hollow right circular cylinder having one open end and a second central longitudinal axis, the flexible liner being fixed to a perimeter of the one open end, and the second central longitudinal axis being coincident with the central longitudinal axis of the warhead.

6. The warhead of claim 5, wherein the rigid material portion includes a telescoping portion that moves the flexible liner between concave, neutral, and convex positions.

7. The warhead of claim 6, wherein the flexible liner is symmetric about the central longitudinal axis of the warhead.

8. The warhead of claim 1, wherein the rigid material portion of the housing includes a pair of opposed end plates and the flexible liner is fixed to and extends between the pair of opposed end plates to form a side wall of the housing, the side wall of the housing being movable between concave, neutral, and convex positions by altering a volume of the fluid in the housing.

9. The warhead of claim 8, wherein the side wall formed by the flexible liner is a 360 degree side wall.

10. The warhead of claim 9, further comprising a framework in the form of a grid disposed between the side wall and the high explosive material, the grid including a plurality of longitudinal members extending between the pair of opposed end plates and a plurality of circumferential members extending around the side wall.

11. The warhead of claim 10, wherein the plurality of longitudinal members are circumferentially equally spaced.

12. The warhead of claim 11, wherein the plurality of circumferential members are longitudinally equally spaced.

13. The warhead of claim 12, wherein the side wall is fixed to the plurality of longitudinal members and the plurality of circumferential members to form an individually movable sub-curvature for each opening in the grid.

14. The warhead of claim 13, wherein the sub-curvatures are movable between concave, neutral, and convex positions by altering the volume of the fluid in the housing.

15. A method, comprising:

providing the warhead of claim 1; and adjusting a shape of the flexible liner to thereby alter a fragmentation pattern of the warhead.

16. The method of claim 15, wherein the step of adjusting includes adjusting the shape of the flexible liner between concave, neutral, and convex positions.

17. The method of claim 15, wherein the step of providing includes providing the warhead with the rigid material portion of the housing generally in a shape of a hollow right circular cylinder having one open end and a second central longitudinal axis, and with the flexible liner fixed to a perimeter of the one open end, and with the second central longitudinal axis coincident with the central longitudinal axis of the warhead.

18. The method of claim 17, wherein the step of adjusting includes adjusting the shape of the flexible liner by altering a volume of the fluid.

19. The method of claim 17, wherein the step of providing includes providing the rigid material portion with a telescoping portion and the step of adjusting includes translating the telescoping portion.

20. A fragmentation warhead with a central longitudinal axis, comprising:

a housing having a portion formed of a flexible liner and a portion formed of a rigid material;

a high explosive material disposed in the housing;

a fluid disposed between the high explosive material and the flexible liner, the fluid being contiguous with and bearing on an inner surface of the flexible liner; and one of a plurality of rigid fragments and a plurality of explosively formed projectile liners fixed to an outer surface of the flexible liner opposite the fluid, wherein the rigid material portion of the housing includes a pair of opposed end plates and the flexible liner is fixed to and extends between the pair of opposed end plates to form a side wall of the housing, the side wall of the housing being movable between concave, neutral, and convex positions by altering a volume of the fluid in the housing, and wherein the side wall formed by the flexible liner is a 360 degree side wall, and further comprising a framework in the form of a grid disposed between the side wall and the high explosive material, the grid including a plurality of longitudinal members extending between the pair of opposed end plates and a plurality of circumferential members extending around the side wall, wherein the plurality of longitudinal members are circumferentially equally spaced.

21. The warhead of claim 20, wherein the plurality of circumferential members are longitudinally equally spaced.

22. The warhead of claim 21, wherein the side wall is fixed to the plurality of longitudinal members and the plurality of circumferential members to form an individually movable sub-curvature for each opening in the grid.

23. The warhead of claim 22, wherein the sub-curvatures are movable between concave, neutral, and convex positions by altering the volume of the fluid in the housing.

* * * * *